US006183229B1

(12) United States Patent
Friedmann

(10) Patent No.: US 6,183,229 B1
(45) Date of Patent: Feb. 6, 2001

(54) HYDRAULIC APPARATUS

(75) Inventor: Oswald Friedmann, Lichtenau (DE)

(73) Assignee: LuK Getriebe-System GmbH, Buhl (DE)

( * ) Notice: Under 35 U.S.C. 154(b), the term of this patent shall be extended for 0 days.

(21) Appl. No.: 09/203,916

(22) Filed: Dec. 2, 1998

(30) Foreign Application Priority Data

Dec. 3, 1997 (DE) ..... 197 53 558

(51) Int. Cl.[7] ..... F01C 1/10
(52) U.S. Cl. ..... 418/170; 418/206.4
(58) Field of Search ..... 418/170, 206.4

(56) References Cited

U.S. PATENT DOCUMENTS 3,890,066 6/1975 Eckerle .
3,912,427 10/1975 Eckerle et al. .
4,132,514 * 1/1979 Eckerle ..... 418/71
4,472,123 9/1984 Eckerle et al. .
4,740,142 * 4/1988 Rohs et al. ..... 418/21
5,499,910 * 3/1996 Hundt et al. ..... 418/126

FOREIGN PATENT DOCUMENTS 1553014 8/1969 (DE) .
29 42 417 A1 8/1981 (DE) .
1 453 318 10/1976 (GB) .

* cited by examiner

*Primary Examiner*—Thomas Denion
*Assistant Examiner*—Thai-Ba Trieu
(74) *Attorney, Agent, or Firm*—Darby & Darby

(57) ABSTRACT

The invention is embodied in a hydraulic gear machine, such as for example a pump or motor, with at least one multistage pressure building slot in an axial plate of the housing. The slot is designed to facilitate a gradual rise of fluid pressure between the mating teeth of the gears and to reduce the noise being generated by the machine as a result of advancement of fluid from a suction inlet to an outlet for pressurized fluid.

18 Claims, 5 Drawing Sheets

HYDRAULIC APPARATUS

BACKGROUND OF THE INVENTION

The invention relates to hydraulic gear machines, such as pumps or motors, especially internal gear machines or spur gear machines of the type having a first gear which is rotatably journalled in a housing and a second gear which drives the first gear, as well as with at least one pressure building slot which is provided in the housing.

Hydraulic gear machines of the above outlined character are known, for example, from published German patent application Serial No. 2942417, U.S. Pat. No. 4,472,123 and published German patent application Serial No. 1553014. These gear machines have pressure building slots which are provided in the axial plates of the housing and, in a plan view, have a triangular outline. The pressure building slots in the axial plates of the housing in a gear machine serve to ensure a more uniform pressure application or pressure rise which is effected all the way to a plenum chamber and, in the event that the gear machine is used as a pump, there takes place a pressure rise and a rise in the rate of delivery from a suction chamber to a plenum chamber. When such gear machine is in use, it conveys a fluid from the suction chamber to the plenum chamber.

When such gear machines are used as pumps for motor vehicle aggregates, and especially for the transmissions of motor vehicles, such as for continuously variable speed transmissions with pulleys employing conical flanges, for example to convey a fluid, such as oil, from a sump to act upon adjusting members and/or for lubrication and/or cooling, the pump draws from the sump—during certain stages of operation of the vehicle—oil which contains a relatively high percentage of air, for examples a mixture of air and oil whereas, during other stages of operation of the vehicle, there is conveyed oil or an oil-air mixture which contains a relatively low percentage of air.

In known prior art pumps, the above brings about the drawback that the preliminary compression or the regulation of pressure by way of pressure building slots which—when looked at from above—have a triangular outline, and when the oil contains a relatively high percentage of air, takes place abruptly, i.e., in response to a relatively small angular displacement of the pinion. On the other hand, when the oil contains a relatively small percenage of air, the regulation of pressure takes place in response to a relatively larger angular displacement of the pinion, namely an angular displacement corresponding to the extension of the pressure building slot.

Pressure equalization during a relatively small angular displacement when the oil contains a high percentage of air entails a rather unsatisfactory acoustic behavior of the pump because, when the percentage of air in oil is relatively high, this causes the pressure rise to take place at a relatively high speed which, in turn, generates pressure waves causing a reduced acoustic quality.

OBJECT OF THE INVENTION

An object of the invention is to provide a hydraulic gear machine which exhibits improved acoustic characteristics by causing relatively low-velocity pressure rises even if the percentage of air or outside air in the oil to be conveyed varies, for example, under different operational conditions.

SUMMARY OF THE INVENTION

This object is achieved in the novel hydraulic gear machine by the provision of at least one pressure building slot which is of a multistage design and has at least two sections, an increase of the cross sections of individual sections taking place at different rates as a function of their extension. The extension can be interpreted as the length of the slot and/or for example also the extent of angular displacement of the gear which sweeps over or rotates along the slot.

Furthermore, it is possible to achieve the object in a hydraulic gear machine, such as a pump or motor, with a first gear which is rotatably journalled in the housing and a second gear which drives the first gear, with at least one filler piece disposed in a cavity between the first and second gears and a filler pin serving as an abutment for the filler piece, as well as with at least one pressure building slot provided in the housing. The slot is of a multistage design and comprises at least two sections with the cross sections of individual sections increasing at different rates as a function of their extension. If one employs conventional pressure building slots, an increase of the slots, as considered along their extension, is uniform in that each slot has a triangular shape or the area of the slot is even constant along its extension.

In accordance with another inventive concept, it is advisable that at least one pressure building slot comprise at least two first and second sections, the first sections of the pressure building slot exhibiting a divergent cross section and the second sections of the pressure building slot exhibiting a substantially constant cross section.

It is also particularly advantageous, in a hydraulic gear machine with a first gear which is rotatably journalled in a housing and a second gear which drives the first gear, with at least one filler disposed between the first and second gears and a filler pin serving as an abutment for the filler, as well as with at least one pressure building slot provided in the housing, if the at least one pressure building slot comprises first and second sections, the first sections of the pressure building slot having a divergent cross section and the second sections of the pressure building slot having an essentially constant cross section.

It is equally advisable that at least one pressure building slot comprise at least two sections having essentially different cross sections.

Furthermore, it is advisable that the first gear be an internally toothed hollow gear and the second gear constitute an externally toothed pinion.

It is also of advantage if each of the first and second gears constitutes an externally toothed gear.

It is further particularly advantageous if the hydraulic gear machine is provided with a radially inner and a radially outer pressure building slot.

It is equally advisable if at least one pressure building slot comprises three different sections.

Furthermore, it can be of advantage in accordance with a further embodiment of the invention if the filler consists of two filler portions and pressure zones are formed between the filler portions by seals, at least some of the pressure zones being connected, by a single channel, with a section of the pressure building slot.

In accordance with a further embodiment, it is of particular advantage if at least some plenum chambers are conected, by a single channel, with a section of a pressure building slot. The plenum chambers can be provided in the housing and/or in the axial plates.

The invention will be described, in greater detail, by way of example and without limiting its broadest aspects, with reference to the drawings,

DESCRIPTION OF PREFERRED EMBODIMENTS

Figure 1:
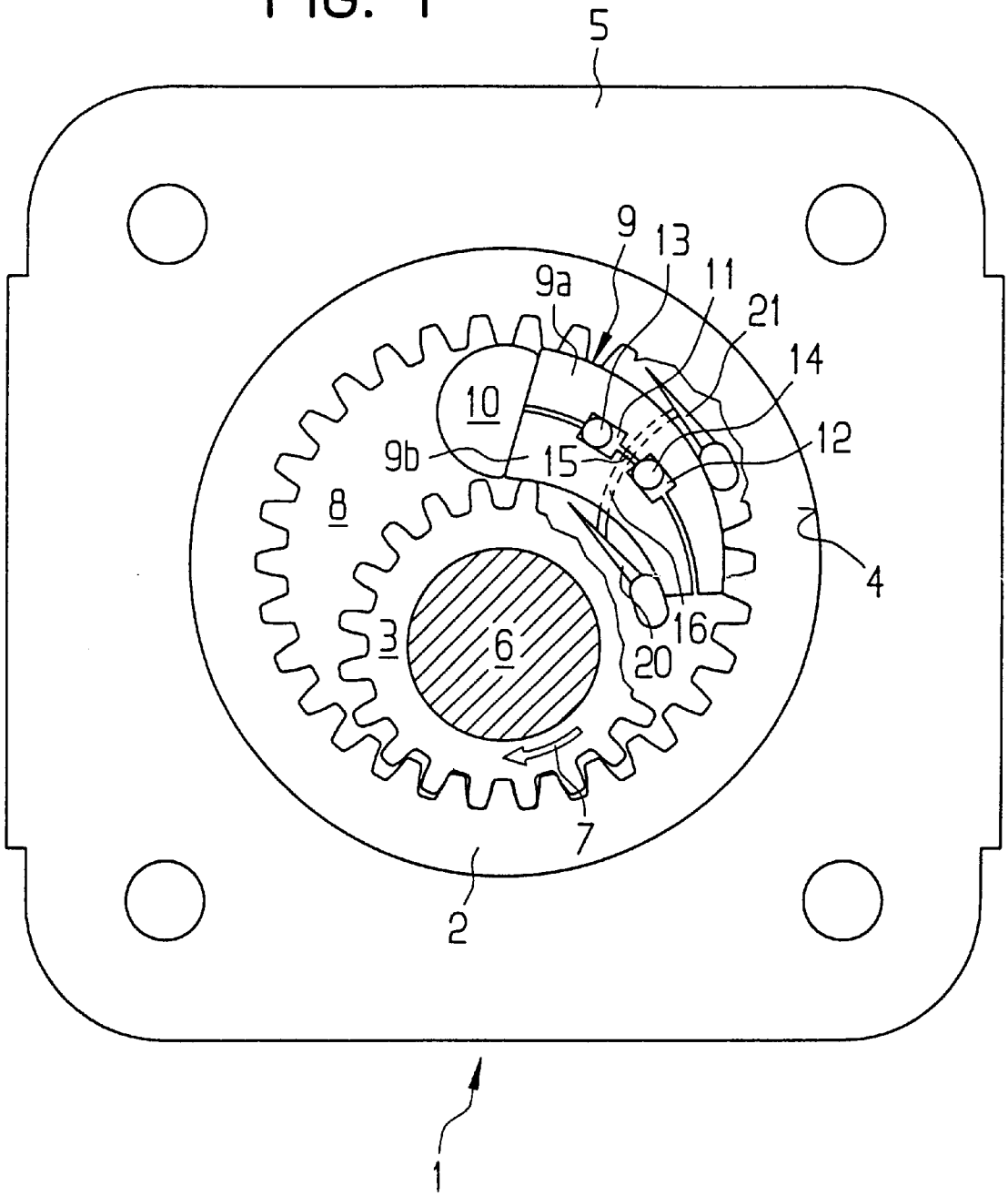
FIG. 1 shows a gear machine in accordance with the state of prior art.

FIG. 1 shows a gear machine 1 in accordance with the state of art wherein an internally toothed hollow gear 2 and an externally toothed pinion 3 are rotatably mounted in a bore 4 of a housing 5. The pinion 3 is rotatably mounted in the housing 5 by way of a pinion shaft 6 and is adapted to be driven by this shaft. The housing 5 preferably comprises several parts including two axial plates and a central housing portion having the bore 4 and being disposed between the axial plates. These component parts define the internal space of the pump, in which the gears are installed, and such component parts seal the internal space with the exception of a connection and an outlet. The direction of rotation of the pinion is indicated by the arrow 7.

Between the teeth of the internally toothed hollow gear 2 and the externally toothed pinion 3, there is provided a sickle-shaped cavity 8 in which is disposed a one-piece filler or a divided filler 9 with filler portions 9*a,* 9*b* abutting and/or being supported by the filler pin 10. The filler pin 10 extends across the cavity 8 and is held in, preferably in the bores of, the axial plates.

The filler portions 9*a*, 9*b* comprise lateral surfaces which are adjacent each other. Such neighboring lateral surfaces of the two filler portions are provided with spaced apart recesses 11, 12 in which are installed seals or sealing elements 13, 14. A channel 16 is in fluid-conveying communication with the intermediate space 15 between the sealing elements.

The axial plates are provided with pressure building or prefilling slots 20, 21. These slots are provided in the region of the front sides of the teeth of the hollow gear 2 and pinion 3. Such pressure building or prefilling slots 20, 21 define prefilling zones wherein a pressure regulation takes place between the tooth spaces of the hollow gear and/or pinion all the way to a plenum chamber in response to rotation of the shaft 6. These pressure building slots 20, 21 are connected with each other by way of the channel 16 and are also connected with the space 15.

The space 15 serves for pressure equalization between the fluid in such space and the fluid in the pressure building slots 20, 21. This ensures a conformance of the effect of radial forces applied by the filler portions upon the heads of the teeth of the pinion 3 and hollow gear 2 to the pressure conditions prevailing thereat and, therefore, the operational pressure prevailing between the filler portions is not as high as that prevailing, for example, at the outlet region of the pump. If the elevated pressure were to prevail between the filler portions, the radial force acting upon the heads of the teeth would cause an excessive stressing of the heads of the teeth which would entail a shorter useful life of the pinion and the hollow gear.

Figure 2:
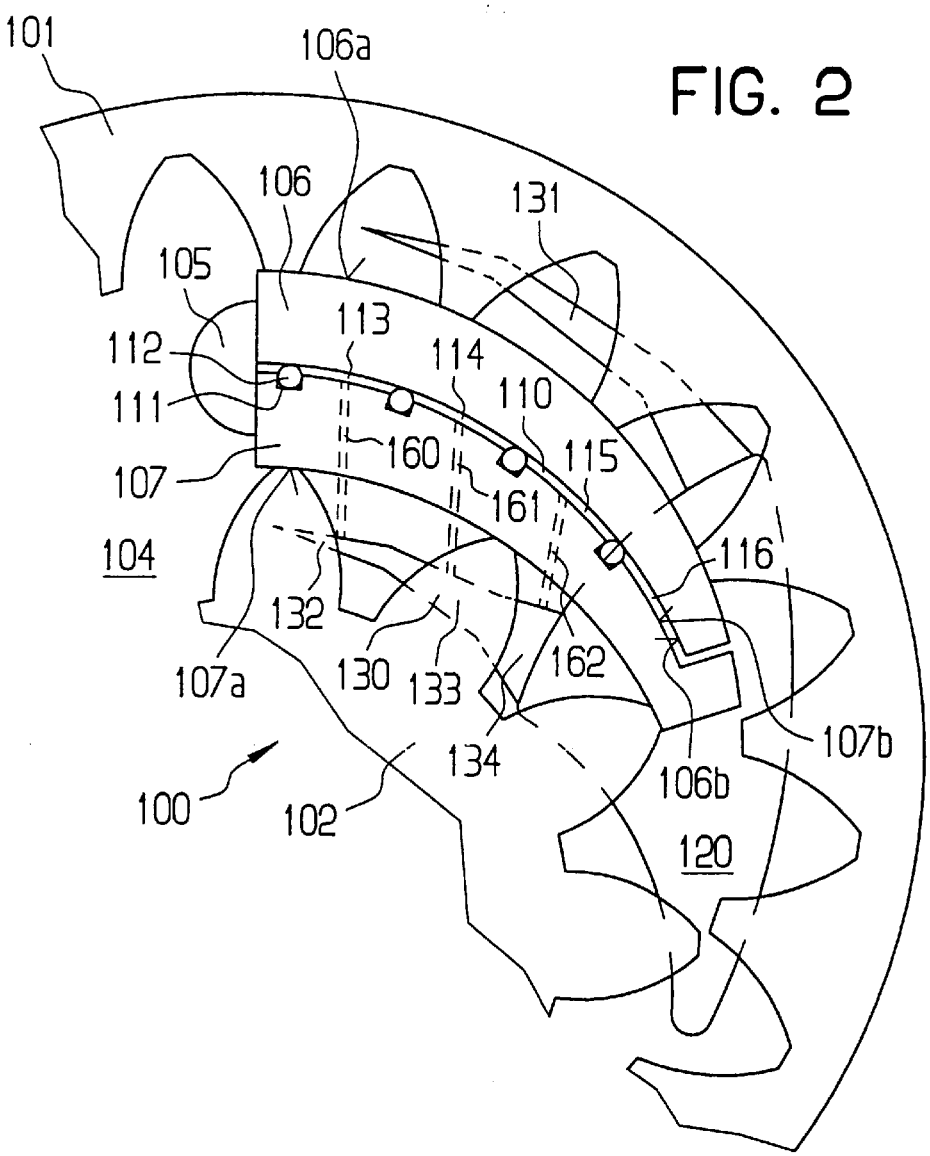
FIG. 2 shows a portion of a gear machine in accordance with one embodiment of the invention.

FIG. 2 shows a portion of a novel gear machine 100, such as an internal gear pump, with an internally toothed hollow gear or internal gear 101 and an externally toothed pinion 102 which drives the hollow gear. As is well known, the hollow gear 101 and the pinion 102 are rotatably mounted in a housing, the pinion being mounted on a pinion shaft and being adapted to be rotated by way of such shaft. The housing comprises a central housing body and axial plates 150 (see FIGS. 2*a* and 2*b*). The central housing body is provided with a cavity, such as a bore, which receives the hollow gear and the pinion, and the axial plates 150 establish the boundaries of the cavity.

A sickle-shaped cavity 104 is provided in the housing between the hollow gear 101 and the pinion 102 and receives a filler pin 105 which is held by the axial plates 150, preferably in bores in the housing of the internal gear machine. The filler pin 105 supports the two portions 106,107 of a composite filler. The filler portions 106, 107 have lateral surfaces or outer surfaces 106*a,* 107*a* which respectively abut the heads of teeth of the hollow gear 101 and pinion 102. The other or inner lateral surfaces 106*b,* 107*b* of the filler portions 106, 107 are adjacent to and can abut each other, or (and as shown in FIG. 2) they are slightly spaced apart which makes it possible to provide between the two neighboring lateral surfaces 106*b,* 107*b* a gap or space 110.

In the region of the gap 110, the lateral surface 106*b* and/or the lateral surface 107*b* is provided with recesses 111 which receive sealing elements 112. In the embodiment of FIG. 2, there are provided four such recesses 111 and four sealing elements 112. Between each pair of sealing elements 112, there are provided chambers 113, 114, 115. A further chamber 116 is disposed between one of the sealing elements 112 and a plenum chamber 120. The number of seals 112 can depart from the number shown in FIG. 2.

The axial plates 150 are further provided with pressure building slots 130 and 131. These pressure building slots can have multiple stages or they can be stepped, and they change their cross sections as a function of the extent of angular displacement of the pinion 102. Thus, in a first stage 132 of the slot 130, the increases of the cross-sectional area as a function of angular displacement are smaller, in a second stage 133 the cross-sectional area as a function of the extent of angular displacement increases, and in a third stage 134 the increase of the cross-sectional area as a function of the extent of angular displacement is greatest. The same holds true for the pressure building slot 131 in the region of the hollow gear 101. Thus, the increase of the cross-sectional area in various regions of the pressure increasing slot varies as a function of the extent of angular displacement of the pinion 102. If one resorts to a conventional pressure increasing slot, the variation of the cross section of the slot as a function of its extension is uniform.

Figure 2A:
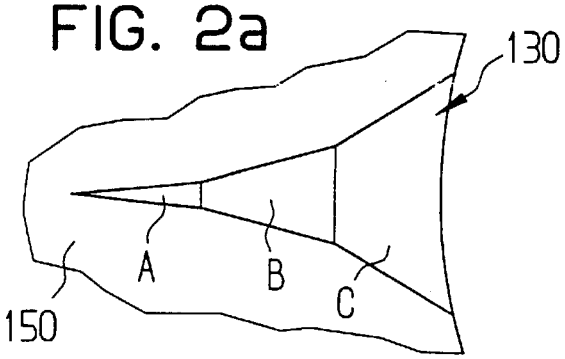
FIG. 2*a* is a plan view of a pressure building slot in the machine of FIG. 2.

FIG. 2*a* shows a pressure building slot 130 in a plan view of the axial plate 150 which is not drawn to scale. The pressure building slot 130 is subdivided into sections A, B and C, the increase of the width of the slot 130 as a function of the extent of angular displacement of the pinion 102 or the extension of the slot 130 being smallest in the section A, being larger in the section B, and being largest in the section C.

Figure 2B:
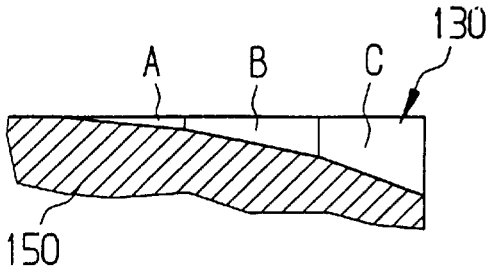
FIG. 2*b* is a sectional view of the pressure building slot shown in FIG. 2*a,*

FIG. 2*b* shows a pressure building slot 130 in a sectional view of the axial plate 150 which is not drawn to scale. This pressure building slot 130 is subdivided into the three sections A, B and C, and the increase of the depth of the slot as a function of the extent of angular displacement of the pinion 102 is smallest in the section A, larger in the section B, and largest in the section C.

Thus, the increase of the cross section is smallest in the section A, larger in the section B, and largest in the section C of each slot 130.

The stages or sections or portions 132(A), 133(B) and 134(C) are in fluid conveying communication with the chambers 113, 114 and 115 by way of channels 160, 161, 162 in one axial plate 150 to thus ensure a pressure equalization between such portions of the slot and the chambers. This ensures that a pressure compensation in the portions 113, 114 and 115 conforms to the pressures being established in the pressure building slots.

In correspondence with the description concerning the increase of the cross-sectional area of the pressure building slot 130, the pressure building slot 131, too, can be of a corresponding multistage design with a varying increase of its cross-sectional area. Analogously, the channels 160, 161 and 162 can be connected with the respective sections of the pressure building slot 131. Furthermore, it can also be of advantage if the channels connect the respective sections of the pressure building slots 130, 131 to thus establish fluid conveying paths to the chambers 113, 114 and 115.

An advantage of the improved gear machine is that the conveying of oil containing different percentages of air or outside air can take place with more or less unchanging acoustic qualities.

In vehicle transmissions, especially in continuously variable speed transmissions (CVT), such as transmissions employing pulleys with conical flanges and coupling means trained over them, oil is mixed with air at different rates during different stages of operation so that a different percentage of air is present under different operating conditions of the vehicle or the transmission. The percentages of air can amount to between a few pro mille and more than 10% which latter, in comparison with an air percentage of a few pro mille or percent during normal operation, brings about pronounced changes in the acoustic behavior of the pump.

In accordance with the invention, the pressure building slots are of a multistage or stepped design as a function of the extent of angular displacement so that, during lubrication with different compressibilities, i.e., with lubricant containing different percentages of air, the buildup of pressure in the tooth spaces can take place in a planned manner.

The design of multistage pressure building slots with a profiling of a first section is such that the first section is preceded by at least one second section and possibly a third section, and preferably also additional sections. The second section and the third section exhibit a more pronounced increase of the cross-sectional area as a function of the extent of angular displacement of the pinion than the first section. Furthermore, the increase of the cross section of the third section as a function of the extent of angular displacement of the pinion is greater than that of the second section.

The first section takes up a relatively small part of the pressure building slot. The purpose of this is that, when the oil contains a relatively small percentage of air, the pressure of oil in a tooth space should conform to or at least approximate the pressure prevailing in the compressing region. This is accomplished with the increasing cross section as a function of the extents of angular displacement of the pinion because, at such time, the tooth space moves toward the plenum chamber along a portion of the pressure building slot which has an increasing cross section.

In the case of conveyed media, namely oil, the compressibility of which is very pronounced, for example, due to a high percentage of air, the effect of small pressure building slots in the front section (A) is very small so that the filling losses attributable to the high percentage of air cannot be compensated for by the next-following flow of oil. When a tooth space reaches the region of the plenum chamber, this would entail an abrupt rise of pressure to the operating pressure. This, in turn, would result in a relatively high-velocity increase of pressure rise during operation of the vehicle.

If one employs a slot with a stepped increase of the cross section in accordance with the invention, one achieves the improvement when the tooth space is advanced into the second section (B) of the pressure building slot. As a rule, the second section of the pressure building slot is effective only when the oil contains a relatively high percentage of air because the prefilling quantities which are required are admitted into the tooth space by way of the second prefilling stage. This results in a slowed-down pressure rise to a value which, in the absence of the second stage or the second section of the slot, could be carried out only when the tooth space reaches the plenum chamber. For example, the second stage of the pressure building slot is of advantage when the oil is in a pronouncedly foamy condition.

In the event that the foaminess of oil is even more pronounced, i.e., the percentage of air is even higher, the cross section of the second section (B) might not be sufficient. This is the reason for the provision of the optional third section (C).

In addition to the narrow slit of the first section (A) and the somewhat widened slit of the second section (B), it is advisable—in the event that oil contains a high percentage of air, for example, with numerous air bubbles—to provide a third section (C) of the pressure building slot because the cross sections of the two sections A and B do not suffice to make available the required prefilling quantities and to avoid, for example, shocks which are caused by cavitation.

If one resorts to three sections A, B and C, the cross section of the slot varies basically continuously as a function of the extent of angular displacement of the gear (pinion and/or hollow gear), and the increase of cross section as a function of the extent of angular displacement is different in each of the sections. In accordance with another advantageous embodiment of the invention, it might be of advantage to interpose between the sections A, B and C partial sections having an unchanged cross section as a function of the extent of angular displacement.

The pressure building slots are preferably provided in the walls of the axial plates of the housing. In accordance with a further embodiment of the invention, it might be advisable to provide the slots radially at the filler of an internal gear pump. In accordance with an additional embodiment, it might be advisable to provide the slots radially on the housing of an internal gear pump.

Figure 3:
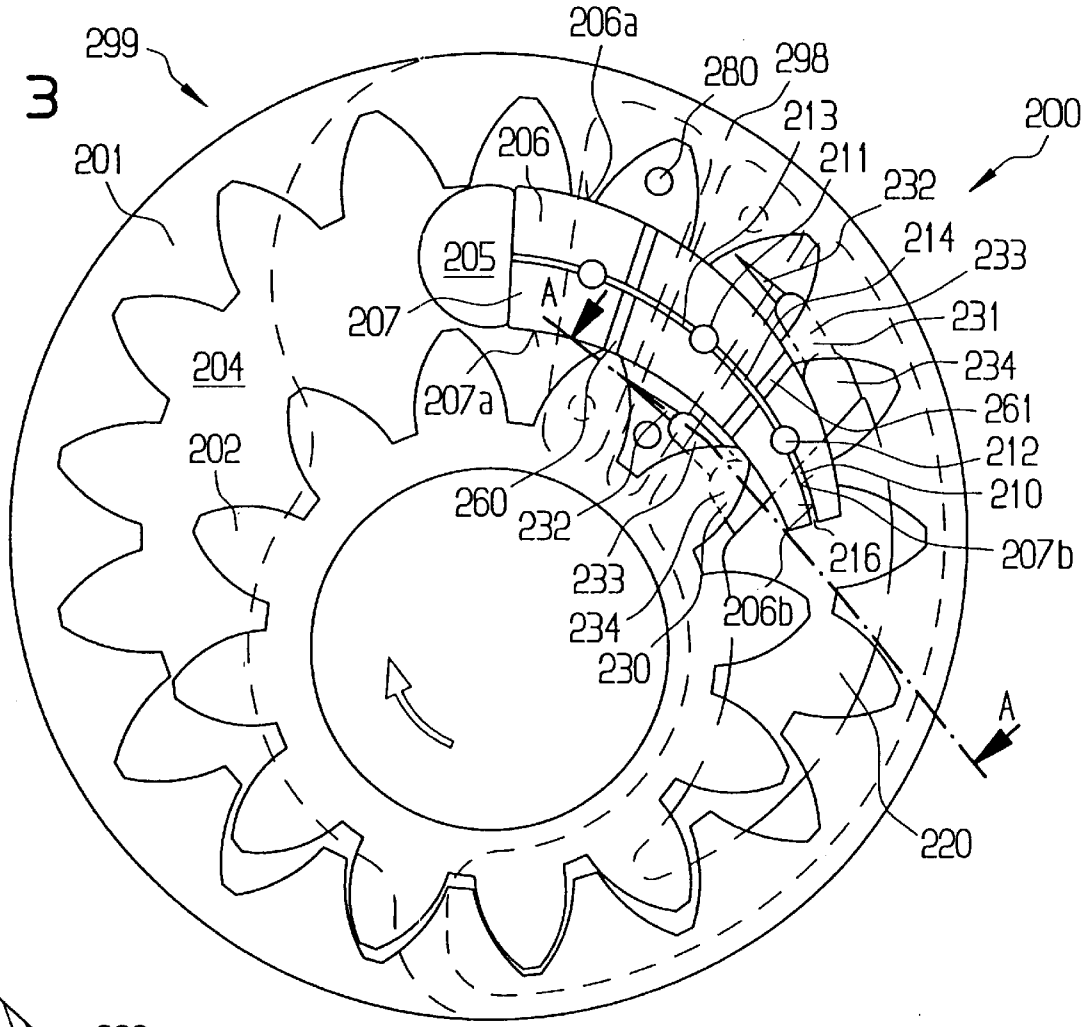
FIG. 3 shows a modified gear machine according to the invention.

FIG. 3 shows a novel gear machine 200, such as an internal gear pump, with an internally toothed hollow gear 201 and an externally toothed pinion 202 which drives the hollow gear. As is customary, the hollow gear 201 and the pinion 202 are rotatably mounted in a housing 299, the pinion 202 being provided on a non-illustrated pinion shaft and being adapted to be driven by such shaft. The housing 299 comprises a central housing body and axial plates 298. The central housing body defines a cavity, such as a bore, which receives the hollow gear and the pinion.

In a substantially sickle-shaped cavity or space 204 between the hollow gear 201 and the pinion 202, there is provided a filler pin 205 which is supported by the axial plates 298 of the internal gear machine 200. Filler portions 206 and 207 are supported by this filler pin 205. The filler portions 206, 207 respectively have outer lateral surfaces 206*a* and 207*a* which respectively abut the heads of the teeth on the hollow gear 201 and pinion 202. The other lateral surfaces 206*b*, 207*b* of the filler portions 206, 207 are adjacent and abut each other or they can define a gap 210.

In the region of the gap 210, the lateral surface 206*b* and/or the lateral surface 207*b* has angular or round (semispherical) recesses 211 which receive sealing elements 212. In the embodiment of FIG. 3, there are provided three recesses 211 and three sealing elements 212. Chambers 213 and 214 are provided between the respective pairs of sealing elements 212, and a further chamber 216 is disposed between one sealing element 212 and a plenum chamber 220.

The axial plates 298 are further provided with pressure building slots 230 and 231. These pressure building slots are of a multistage or stepped design and their cross sections vary as a function of the extent of angular displacement of the pinion 202, the increase of the cross section as a function of the extent of angular displacement being small in a first section 232, the increase of the cross section as a function of the extent of angular displacement being larger in a second section 233, and the increase of the cross section as a function of the extent of angular displacement being largest in a third section 234. The same applies for the pressure building slot 231 in the region of the hollow gear 201. Thus, the pronouncedness of the increase of the cross section as a function of the extent of angular displacement is different in the various sections of each pressure building slot.

Between the chambers 213 and 214 and the sections 232 and 233, there are provided channels 260, 261 which effect an equalization of pressure between the pressure building slots and the chambers.

Figure 3A:
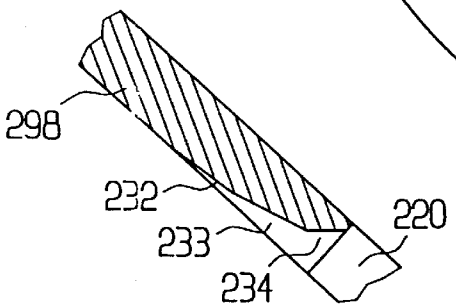
FIG. 3*a* shows a pressure building slot in a sectional view as seen in the direction of arrows from the line IIIa—IIIa in FIG. 3.

FIG. 3*a* shows a section of an axial plate 298 as seen in the direction of arrows from the line IIIa—IIIa in FIG. 3. Each pressure building slot basically comprises three sections 232, 233 and 234 before the section 234 discharges into the plenum chamber 220. The width and the depth of the section 232 increase continuously with increasing extent of angular movement of the pinion 202. The widths of the sections 233 and 234 of the pressure building slots remain essentially constant, the depths of these sections increasing substantially continuously in response to increasing extent of angular movement.

Due to the stepped design of the pressure building or prefilling slots 230, 231, the extent of angular movement within which the pressure in a tooth space reaches the operating pressure is subject to pronounced fluctuations in dependency upon the percentage of air in the oil. This renders it desirable to conform the compensating forces between the portions of the filler to the radially acting operational pressure in leak gap compensated internal gear pumps. This is accomplished by the subdivision of the compensating surfaces 206*b*, 207*b* which are disposed between the filler portions 206, 207 in that these surfaces are separated from each other by the seals 212 and are connected with the slots 230, 231 at the sides of gears by the channels 260, 261 and bores (if necessary).

Figure 4A:
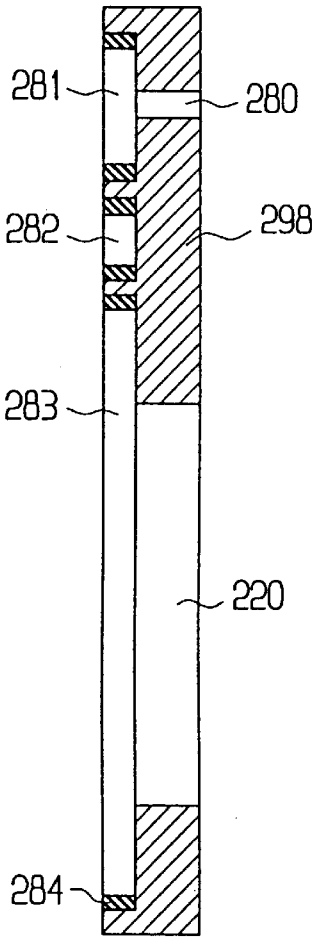
FIG. 4*a* is a sectional view as seen in the direction of arrows from the line IVa—IVa in FIG. 4.
Figure 4:
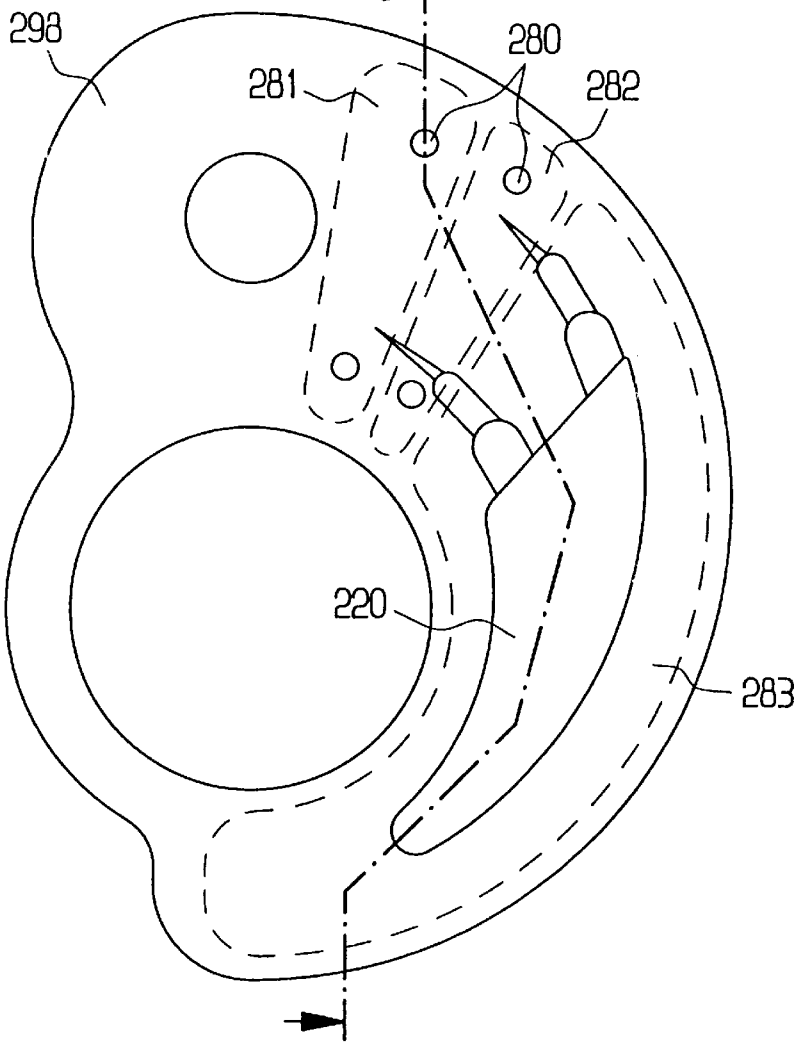
FIG. 4 is a plan view of an axial plate in the housing of the machine shown in FIG. 3.

Due to differences between the pressures in the pressure zones, it is advisable to provide an axial compensation for the magnitude of the pressure upon the axial plates 298. This is accomplished, see FIGS. 4 and 4*a*, in that the plenum chambers 281, 282 and 283 which are provided in the axial plates 298 are connected with the sections 232, 233 and 234 by way of bores 280, the plenum chambers 281, 282 and 283 being sealed individually and from each other by means of seals 284.

Figure 5:
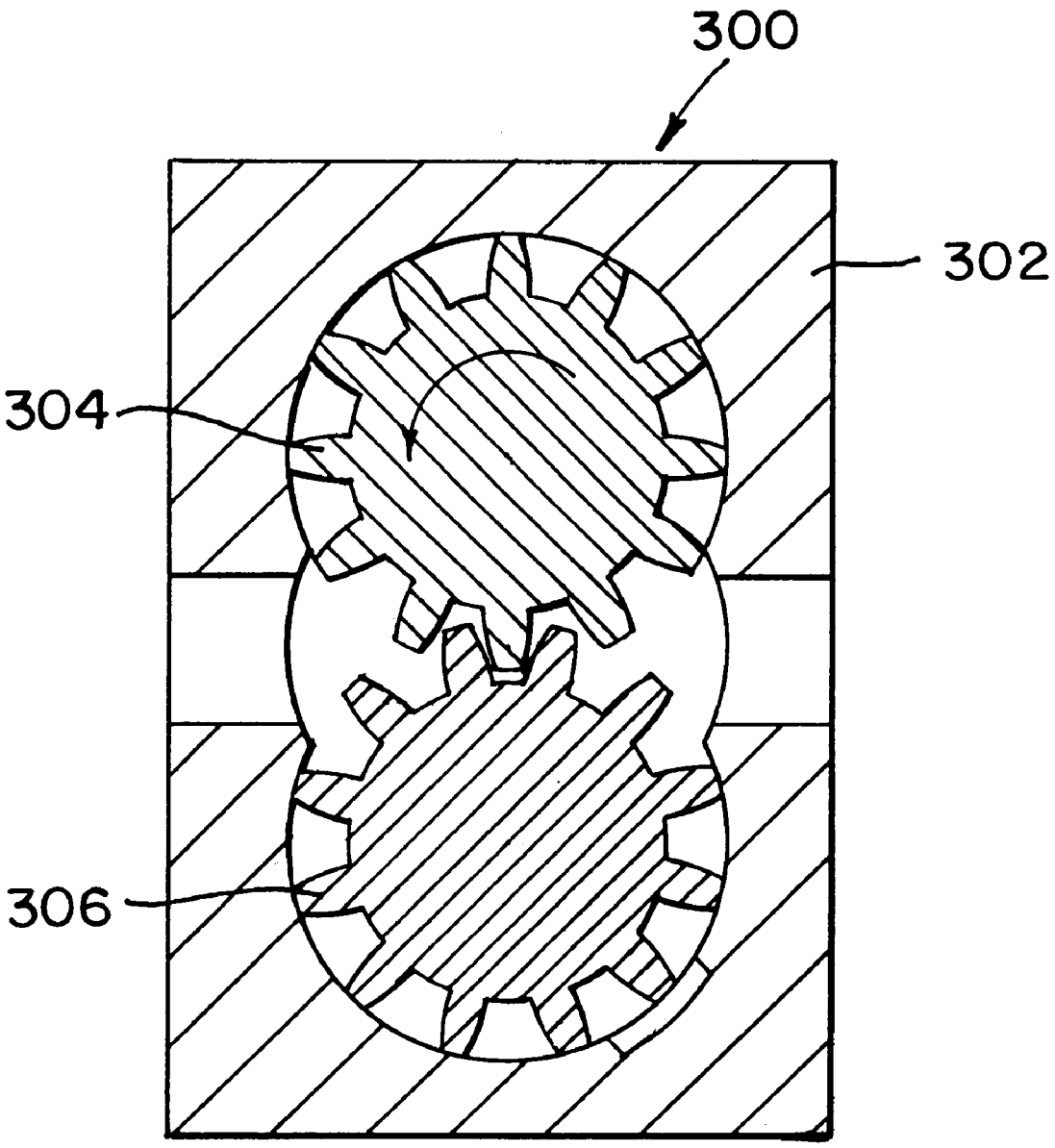
FIG. 5 is a sectional view showing another embodiment according to the present invention.

FIG. 5 shows another embodiment of the present invention in which a portion of a gear machine 300 is illustrated. The gear machine 300 includes a housing, generally indicated at 302, having a first externally toothed gear 304 and a second externally toothed gear 306 rotatably mounted therein. In this embodiment, the first and second externally toothed gears 304, 306, respectively, are both externally toothed gears which mesh with one another. It will be understood that the housing 302 includes at least one of the novel pressure building slots described hereinbefore with reference to earlier Figures. FIG. 5 is intended to illustrate the practice of the present invention in a gear machine 300 using a pair of externally toothed gears 304, 306.

The invention further relates to earlier published German patent applications Serial Nos. 1553014 and 2942417, U.S. Pat. Nos. 4,472,123, 3,890,066, 3,912,427 and 4,132,514, and UK patent GB 1 453 318 the disclosures of all of which are incorporated herein by reference.

What is claimed is:

1. A hydraulic gear machine comprising a housing; a first toothed gear rotatably mounted in said housing; and a driven second toothed gear rotatably mounted in said housing and meshing with said first gear to jointly convey a fluid from the fluid-admitting inlet of said housing to an outlet for pressurized fluid provided in said housing, said housing having at least one pressure building slot for the fluid flowing from said inlet to said outlet, at least a portion of said at least one slot having a cross-sectional area which increases in the direction of fluid flow from said inlet to said outlet, wherein said slot has a plurality of successive sections, as seen in said direction, and the cross-sectional areas of said successive sections increase at different rates.

2. The machine of claim 1, wherein the teeth of said gears define a cavity which narrows in said direction, and further comprising at least one filler provided in said cavity and a filler pin provided in said cavity and abutting said at least one filler, said at least one slot having at least two successive sections as seen in said direction and the cross-sections of said sections varying at different rates.

3. The machine of claim 1, wherein said at least one slot includes a second portion having an at least substantially constant cross-sectional area.

4. The machine of claim 1, wherein the teeth of said gears define a cavity which narrows in said direction, and further comprising at least one filler provided in said cavity and a filler pin provided in said cavity and abutting said at least one filler, said at least one slot including at least one second portion having a substantially constant cross-sectional area.

5. The machine of claim 1, wherein said portion of said at least one slot includes at least two successive sections, as seen in said direction, and the cross-sectional areas of said at least two sections varying at different rates.

6. The machine of claim 1, wherein one of said gears is an internal gear and the other of said gears is an externally toothed gear.

7. The machine of claim 1, wherein said gears are externally toothed gears.

8. The machine of claim 1, wherein said housing has a central axis and includes two pressure building slots including a first slot nearer to and a second slot more distant from said axis.

9. The machine of claim 1, wherein said portion of said at least one slot includes three sections having cross-sectional areas which vary at different rates.

10. The machine of claim 1, wherein the teeth of said gears define a cavity which narrows in said direction, and further comprising at least one filler provided in said cavity and a filler pin provided in said cavity and abutting said filler, said filler having portions defining a gap and further comprising sealing means provided in said gap and defining a plurality of chambers, said housing having at least one channel connecting at least one of said chambers with said at least one slot.

11. The machine of claim 1, wherein said housing has a central body surrounding said gears and two end walls, at least one of said end walls having at least one Plenum chamber and said housing having at least one channel connecting said at least one plenum chamber of said at least one end wall with said portion of said slot.

12. The machine of claim 1, wherein said housing has plenum chambers to compensate for leakage and at least one channel connecting at least one of said plenum chambers with said at least one pressure building slot.

13. The machine of claim 1, wherein said housing and said gears form part of a pump.

14. The machine of claim 1, wherein said housing comprises a body portion surrounding said gear and two end walls flanking said body portion, said at least one slot being provided in one of said end walls.

15. The machine of claim 1, wherein one of said gears is an internal gear and the other of said gears is a spur gear surrounded by said internal gear.

16. The machine of claim 1, wherein the teeth of said gears define tooth spaces and said at least one slot communicates with several tooth spaces of one of said gears.

17. The machine of claim 16, wherein said housing has a second pressure building slot in communication with the tooth spaces of the other of said gears.

18. The machine of claim 1, wherein the fluid is oil.

* * * * *